US008448309B2

(12) United States Patent
Kim et al.

(10) Patent No.: US 8,448,309 B2
(45) Date of Patent: May 28, 2013

(54) ARAMID NONWOVEN FABRIC AND PREPARATION METHOD THEREFOR

(75) Inventors: Jin-Il Kim, Gumi-shi (KR); Jin-Hwan Choi, Daegu (KR)

(73) Assignee: Kolon Industries, Inc., Kwacheon (KR)

( * ) Notice: Subject to any disclaimer, the term of this patent is extended or adjusted under 35 U.S.C. 154(b) by 349 days.

(21) Appl. No.: 12/741,724

(22) PCT Filed: Nov. 14, 2008

(86) PCT No.: PCT/KR2008/006720

§ 371 (c)(1),
(2), (4) Date: Sep. 10, 2010

(87) PCT Pub. No.: WO2009/064130

PCT Pub. Date: May 22, 2009

(65) Prior Publication Data

US 2010/0323179 A1 Dec. 23, 2010

(30) Foreign Application Priority Data

Nov. 14, 2007 (KR) ..... 10-2007-0116284
Nov. 14, 2007 (KR) ..... 10-2007-0116285

(51) Int. Cl.
*D04H 1/42* (2012.01)

(52) U.S. Cl.
USPC ..... 28/104; 28/107

(58) Field of Classification Search
USPC ..... 28/104, 105, 106, 107, 109–112, 28/114, 103, 167, 165; 156/148
See application file for complete search history.

(56) References Cited

U.S. PATENT DOCUMENTS

| | | | | |
|---|---|---|---|---|
| 4,556,601 | A | 12/1985 | Kirayoglu | |
| 4,748,065 | A | 5/1988 | Tanikella | |
| 4,780,359 | A * | 10/1988 | Trask et al. | 442/224 |
| 6,156,681 | A * | 12/2000 | Tamaru et al. | 442/383 |
| 2001/0006868 | A1 | 7/2001 | Kurumatani et al. | |
| 2002/0142689 | A1 | 10/2002 | Levit | |
| 2004/0089432 | A1 * | 5/2004 | Levit | 162/157.3 |
| 2004/0096629 | A1 | 5/2004 | Aneja et al. | |
| 2004/0116025 | A1 * | 6/2004 | Gogins et al. | 442/340 |
| 2005/0284596 | A1 | 12/2005 | Conley et al. | |
| 2006/0172639 | A1 * | 8/2006 | Yamada et al. | 442/59 |
| 2011/0034100 | A1 * | 2/2011 | Narayanan et al. | 442/402 |

FOREIGN PATENT DOCUMENTS

| | | | |
|---|---|---|---|
| CN | 1714187 | A | 12/2005 |
| EP | 0669994 | B1 | 7/1998 |
| KR | 1991-0006427 | B1 | 8/1991 |
| KR | 10-0250893 | B1 | 5/2000 |
| KR | 10-0330823 | B1 | 3/2002 |
| KR | 10-2004-0100576 | A | 12/2004 |
| KR | 10-2006-0059999 | A | 6/2006 |
| NL | 1010029 | C1 | 3/2000 |
| WO | 95/00692 | A1 | 1/1995 |

* cited by examiner

*Primary Examiner* — Amy Vanatta
(74) *Attorney, Agent, or Firm* — Sughrue Mion, PLLC

(57) ABSTRACT

The present invention relates to an aramid nonwoven fabric showing more improved tenacity and superior heat-insulating property, and a method of preparing the same.
The aramid nonwoven fabric is what includes 10 to 100 wt % of para-aramid staple fibers and 0 to 90 wt % of meta-aramid staple fibers, and has an air permeability of 40 to 200 $cm^3/cm^2/sec$ and an average pore size of 20 to 50 μm. Such aramid nonwoven fabric can be prepared by carding aramid fibers including the para-aramid staple fibers and the meta-aramid staple fibers so as to form a web, needle-punching the same, and water-punching the same with a prescribed water pressure.

6 Claims, 5 Drawing Sheets

ARAMID NONWOVEN FABRIC AND PREPARATION METHOD THEREFOR

CROSS REFERENCE TO RELATED APPLICATIONS

This application is a National Stage of International Application No. PCT/KR2008/006720 filed Nov. 14, 2008, claiming priorities based on Korean Patent Application Nos. 10-2007-0116284 and 10-2007-0116285 both filed Nov. 14, 2007, the contents of all of which are incorporated herein by reference in their entirety.

BACKGROUND OF THE INVENTION (a) Field of the Invention

The present invention relates to an aramid nonwoven fabric and a method of preparing the same. More particularly, the present invention relates to an aramid nonwoven fabric showing more improved tenacity and superior heat-insulating property, and a method of preparing the same.

(b) Description of the Related Art

In industrial field, such as an incineration plant, a metal plant, or a glass plant, where waste gas of high temperature is discharged, an industrial heat-resistant filter for filtering dusts which are included in the waste gas is widely used. Furthermore, an industrial heatproof suit for protecting worker is used because the industrial field requires a working in the circumstance of high temperature.

Hitherto, what is composed of glass fiber is generally used as the industrial heat-resistant filter and the like. However, there were disadvantages of that not only the filter and the like are broken and do not have sufficient durability and life but also they generate secondary pollution in some cases when using the industrial heat-resistant filter and the like for a long time, because the glass fiber does not have sufficient heat-resistance nor tenacity.

Therefore, various trials and investigations for resolving the disadvantages of the glass fiber mentioned above have been accomplished by providing an industrial heat-resistant filter and the like by using materials having sufficient tenacity and heat-resistance.

Among others, the attempt to provide the industrial heat-resistant filter and the like by using an aromatic polyamide fiber, an aramid fiber, has been accomplished. Particularly, the aramid fiber shows relatively good heat-resistance and, among the aramid fibers, a para-aramid fiber shows heat-resistance of some degree and relatively good tenacity and a meta-aramid fiber has low tenacity and yet shows superior heat-resistance, and thus the attempt to apply the nonwoven fabric prepared by using such aramid fibers to the industrial heat-resistant filter and the like have been accomplished.

However, tenacity or heat-insulating property of the aramid nonwoven fabric does not reach to sufficient level yet, and thus the aramid nonwoven fabric showing more superior tenacity and excellent heat-insulating property and the method of preparing the same are continuously required.

SUMMARY OF THE INVENTION

It is an aspect of the present invention to provide an aramid nonwoven fabric showing more improved tenacity and good heat-insulating property.

It is another aspect of the present invention to provide a method of preparing the aramid nonwoven fabric.

The present invention provides an aramid nonwoven fabric, including 10 to 100 wt % of para-aramid staple fibers and 0 to 90 wt % of meta-aramid staple fibers, and having an air permeability of 40 to 200 $cm^3/cm^2/sec$ and an average pore size of 20 to 50 μm.

The present invention also provides a method of preparing an aramid nonwoven fabric, including the steps of carding aramid fibers including 10 to 100 wt % of para-aramid staple fibers and 0 to 90 wt % of meta-aramid staple fibers so as to form a web; needle-punching the web; and water-punching the web with a water pressure of 70 to 350 bar.

DETAILED DESCRIPTION OF THE EMBODIMENTS

Figure 1:
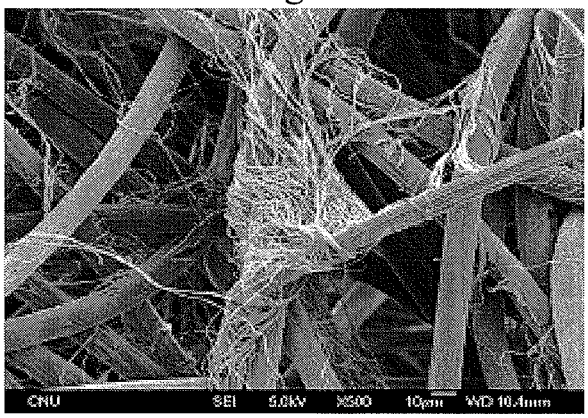
FIGS. 1 to 6 are photos of Scanning Electron Microscopy (SEM) showing microstructures of the aramid nonwoven fabrics prepared in Examples 1 to 6, respectively.
Figure 2:
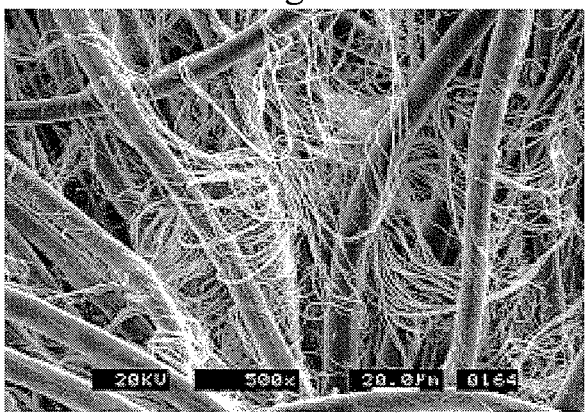

Hereinafter, the aramid nonwoven fabric according to concrete embodiments of the present invention and a method of preparing the same is explained in more detail.

According to one embodiment of the present invention, an aramid nonwoven fabric showing superior tenacity and heat-insulating property is provided. Such aramid nonwoven fabric includes 10 to 100 wt % of para-aramid staple fibers and 0 to 90 wt % of meta-aramid staple fibers, and has an air permeability of 40 to 200 $cm^3/cm^2/sec$ and an average pore size of 20 to 50 μm.

The air permeability of the aramid nonwoven fabric is 40 to 200 $cm^3/cm^2/sec$, relatively low, and smaller pores are formed in the nonwoven fabric, because the para-aramid staple fibers are fibrilized. As shown in the following Examples, it is revealed surprisingly by the present inventors that the aramid nonwoven fabric which has low air permeability and small pores of the above range because the para-aramid staple fibers are sufficiently fibrilized has more improved tenacity, such as a tensile strength, a tear strength, and the like. It may be because the aramid fibers including the para-aramid staple fibers have more developed network structure, as the entanglements of the para-aramid in the nonwoven fabric are increased by fibrilization. Furthermore, it is ascertained that such aramid nonwoven fabric not only shows superior heat-resistance according to the characteristic of the aramid fiber itself, but also does not easily transfer heat even in high temperature circumstances and shows superior heat-insulating property because of the low air permeability and small size of pores.

Therefore, the aramid nonwoven fabric can show superior heat-insulating property and heat-resistance as well as more improved tenacity, and can be preferably applied to an industrial heat-resistant filter, an industrial heatproof suit, and the like.

The aramid nonwoven fabric basically includes the para-aramid staple fibers indispensably and the meta-aramid staple fibers selectively. It is due to that the meta-aramid staple fibers are not fibrilized unlike the para-aramid staple fibers which can be fibrilized, and thus it is difficult to expect the aramid nonwoven fabric including the meta-aramid staple fibers only to show an effect of improving the tenacity by fibrilization.

Furthermore, the aramid nonwoven fabric may include 10 to 100 wt % of the para-aramid staple fibers and 0 to 90 wt % of the meta-aramid staple fibers, preferably may include 50 to 100 wt % of the para-aramid staple fibers and 0 to 50 wt % of the meta-aramid staple fibers, and most preferably may include 50 wt % of the para-aramid staple fibers and 50 wt % of the meta-aramid staple fibers.

According to the testing results of the present inventors, it is ascertained that the para-aramid staple fibers and the aramid fibers including the same can have more developed network structure because the degree of fibrilization increases as the content of the para-aramid staple fibers included in the aramid nonwoven fabric increases, and the tenacity (for example, the tensile strength) of the aramid nonwoven fabric tends to be generally elevated owing to this. Furthermore, it is also ascertained that the tenacity at the fiber direction (MD, machine direction) slightly decreases and yet the tenacity at the perpendicular direction (CD, cross direction) continuously increases, when the content of the para-aramid staple fibers is over 50 wt %. Therefore, it is preferable in the aspect of the tenacity that the aramid nonwoven fabric includes 50 to 100 wt % of the para-aramid staple fibers and 0 to 50 wt % of the meta-aramid staple fibers, and it is more preferable that the nonwoven fabric includes 50 wt % of the para-aramid staple fibers and 50 wt % of the meta-aramid staple fibers.

Furthermore, the aramid nonwoven fabric includes the para-aramid staple fibers basically and the meta-aramid staple fibers selectively, however, it is needless to say that the nonwoven fabric may also include other kind of aramid-based fibers, or other kind of fibers while including the aramid fibers including the para-aramid staple fibers and the meta-aramid staple fibers mainly.

Furthermore, the aramid nonwoven fabric may include the para-aramid staple fibers and the meta-aramid staple fibers which are general, and may include the para-aramid staple fibers and the meta-aramid staple fibers having an average length of 25 to 100 mm and an average thickness of 5 to 20 μm, for example.

In addition to, the aramid nonwoven fabric has an air permeability of 40 to 200 $cm^3/cm^2/sec$ and an average pore size of 20 to 50 μm, and preferably may have an air permeability of 50 to 150 $cm^3/cm^2/sec$ and an average pore size of 30 to 40 μm. The para-aramid staple fibers included in the aramid nonwoven fabric are sufficiently fibrilized in the preparing process of the aramid nonwoven fabric, and the fabric has the low air permeability and the small pore size of above mentioned range, and thus the fabric shows more improved tenacity, small pore size, and superior heat-insulating property, by fibrilization.

Furthermore, the aramid nonwoven fabric may have a density of 0.05 to 0.2 $g/cm^3$ and a thickness of 0.60 to 1.90 mm. As the aramid nonwoven fabric has the density and the thickness of this range, the nonwoven fabric can have superior tenacity, small pore size, and heat-insulating property, while having the thickness suitable to be applied to an industrial heat-resistant filter, an industrial heatproof suit, and the like.

The aramid nonwoven fabric having every characteristics disclosed above can show more improved tenacity. More particularly, the aramid nonwoven fabric can show the tensile strength of 0.30 to 0.55 $kgf/mm^2$ at the fiber direction (MD) and the tensile strength of 0.25 to 0.80 $kgf/mm^2$ at the perpendicular direction (CD, cross direction). Furthermore, the aramid nonwoven fabric can show superior tenacity enough to reach the tear strength of 3.50 to 7.50 kgf and the breaking work of 430 to 1150 kgf·mm at the fiber direction (MD) and the tear strength of 3.50 to 6.50 kgf and the breaking work of 830 to 1600 kgf·mm at the perpendicular direction (CD).

Furthermore, the aramid nonwoven fabric can be preferably applied to an industrial heat-resistant filter, an industrial heatproof suit, and the like, because it shows not only superior heat-resistance that is caused by the intrinsic characteristics of the aramid fibers but also low air permeability of 40 to 200 $cm^3/cm^2/sec$ in company with the superior tenacity mentioned above and thus it does not easily transfer heat even in high temperature circumstances (namely, it shows superior heat-insulating property).

In addition to, according to another embodiment of the present invention, a method of preparing the aramid nonwoven fabric showing superior tenacity, heat-insulating property, and the like is provided. The method of preparing the aramid nonwoven fabric includes the steps of carding aramid fibers including 10 to 100 wt % of para-aramid staple fibers and 0 to 90 wt % of meta-aramid staple fibers so as to form a web, needle-punching the web, and water-punching the web with a water pressure of 70 to 350 bar.

According to the preparing method, the aramid nonwoven fabric is prepared by needle-punching and water-punching a web with a certain water pressure so as to adhering the aramid fibers each other, after forming the web by carding the aramid fibers including the para-aramid staple fibers. However, as shown in the following Examples, it is revealed surprisingly that the para-aramid staple fibers can be sufficiently fibrilized and the aramid nonwoven fabric having low air permeability and small average pore size can be prepared by proceeding the needle-punching and the water-punching processes together (specifically, by proceeding the water-punching process with a certain pressure after needle-punching), as the testing results of the present inventors. The aramid nonwoven fabric may have an air permeability of 40 to 200 $cm^3/cm^2/sec$ and an average pore size of 20 to 50 μm according to one embodiment of the present invention. Namely, the aramid nonwoven fabric prepared by the method mentioned above, in which the para-aramid staple fibers can be sufficiently fibrilized, may have low air permeability and small average pore size according to one embodiment of the present invention. Therefore, the aramid nonwoven fabric prepared by the above method can show more elevated tenacity, such as the tensile strength, the tear strength, and the like, as disclosed above, because of the sufficient fibrilization of the para-aramid staple fibers and the developed network structure of the aramid fibers caused by fibrilization. Furthermore, the aramid nonwoven fabric can show superior heat-insulating property because of the low air permeability and the small average pore size. Therefore, the aramid nonwoven fabric prepared like this can be preferably applied to an industrial heat-resistant filter, an industrial heatproof suit, and the like.

In addition to, firstly, the web is formed by carding the aramid fibers including 10 to 100 wt % of para-aramid staple fibers and 0 to 90 wt % of meta-aramid staple fibers in the method of preparing the aramid nonwoven fabric.

That is, the aramid fibers including the para-aramid staple fibers indispensably and the meta-aramid staple fibers selectively are basically used in the web forming step. It is due to that the meta-aramid staple fiber is not fibrilized unlike the para-aramid staple fiber which can be fibrilized, and it is difficult to expect the aramid nonwoven fabric including the meta-aramid staple fibers only to show an effect of improving the tenacity according to the fibrilization.

Furthermore, the aramid nonwoven fabric may include 10 to 100 wt % of the para-aramid staple fibers and 0 to 90 wt % of the meta-aramid staple fibers, preferably may include 50 to 100 wt % of the para-aramid staple fibers and 0 to 50 wt % of the meta-aramid staple fibers, and most preferably may include 50 wt % of the para-aramid staple fibers and 50 wt % of the meta-aramid staple fibers.

As disclosed above, it is ascertained that the aramid fibers can have more developed network structure or entangled structure, because the degree of fibrilization increases as the content of the para-aramid staple fibers included in the aramid nonwoven fabric increases, and the tenacity (for example, tensile strength) of the aramid nonwoven fabric prepared finally tends to be generally elevated owing to this. Furthermore, it is also ascertained that the tenacity at the fiber direction (MD, machine direction) slightly decreases and yet the tenacity at the perpendicular direction (CD, cross direction) continuously increases, when the content of the para-aramid staple fibers is over 50 wt %. Therefore, it is preferable to use the aramid fibers including 50 to 100 wt % of the para-aramid staple fibers and 0 to 50 wt % of the meta-aramid staple fibers, and it is more preferable to use the aramid fibers including 50 wt % of the para-aramid staple fibers and 50 wt % of the meta-aramid staple fibers in the web forming step.

Furthermore, the aramid nonwoven fabric includes the para-aramid staple fibers basically and the meta-aramid staple fibers selectively, however, the nonwoven fabric can include other kind of aramid-based fibers, and also can include other kind of fibers in addition to the aramid-based fibers.

Furthermore, the aramid fibers may include the para-aramid staple fibers and the meta-aramid staple fibers which are general, and may include the para-aramid staple fibers and the meta-aramid staple fibers having an average length of 25 to 100 mm and an average thickness of 5 to 20 μm, for example.

Furthermore, the web can be prepared by carding the aramid fibers according to the conventional process of preparing nonwoven fabric in the web forming step. The specific method and conditions of the carding method follow the conventional method of preparing nonwoven fabric by using staple fibers.

In addition to, the web is needle-punched after forming the web. As confirmed by the following Examples, it is revealed that the para-aramid staple fibers can be sufficiently fibrilized and the aramid nonwoven fabric having low air permeability and superior heat-insulating property as well as more improved tenacity can be prepared by water-punching the web with a certain water pressure while proceeding the needle-punching process. That is, the needle-punching process is proceeded so that the aramid nonwoven fabric can show more improved tenacity and heat-insulating property by assisting the following water-punching process and fibrilizing the para-aramid staple fibers more.

The concrete proceeding method and conditions of the needle-punching process follow the conventional method of preparing an aramid nonwoven fabric, and it may be proceeded by needle-punching the web with the condition of 300 to 800 times per unit area (for example, 1 $cm^2$) of the web, namely 300 to 800 ppsc (punch/$cm^2$), by using a conventional needle-punching machine, for example.

In the other embodiment of the present invention, the aramid nonwoven fabric is prepared by carrying out the needle-punching process and the water-punching process together so as to adhere the aramid fibers. In the water punching step, the web may be water-punched with a water pressure of 70 to 350 bar, and preferably with a water pressure of 100 to 250 bar. As an experimental result of the present inventors, it is revealed that the degree of fibrilization of the para-aramid staple fibers included in the aramid fibers increases and the air permeability and the average pore size of the aramid nonwoven fabric prepared finally decreases as the water pressure increases in the water punching step, and the tenacity and the heat-insulating property of the aramid nonwoven fabric can be more improved as a result. However, when the water pressure is excessively increased, the additional effect of improving the tenacity is not so much and the aramid fibers composing the web may be lost or damaged in the water-punching step as well.

Furthermore, it is more preferable to carry out the water-punching step by providing water to both sides of the web rather than to only one side of the web. By this, the degree of fibrilization of the para-aramid staple fibers can be elevated still more, and thus the aramid nonwoven fabric showing lower air permeability and superior heat-insulating property as well as more improved tenacity can be obtained.

The water-punching process can be carried out by water-punching the web with a water pressure of 50 to 150 bar preliminarily (pre-step), and then water-punching the web with a water pressure of 70 to 350 bar (main-step). At this time, the water-punching of the main-step is carried out with a water pressure higher than that of the pre-step. Like this, because the pre-step of water-punching the web with lower water pressure before the main-step, it is prevented that the aramid fibers composing the web is lost or damaged by water-punching the web with a sudden high water pressure, and thus the para-aramid staple fiber can be effectively fibrilized in the main-step.

Furthermore, it is possible to water-punch the web while providing water through a nozzle having a diameter of 0.1 to 0.15 mm, and preferably of 0.11 to 0.13 mm, and a density of 10 to 20 ea/cm, and preferably of 14 to 18 ea/cm in the water-punching step. The aramid nonwoven fabric showing lower air permeability and superior heat-insulating property as well as more improved tenacity can be prepared, because the more increased degree of fibrilization of the para-aramid staple fibers may be obtained as the nozzle having the larger nozzle diameter and nozzle density is used in the water-punching step. However, when the water-punching step is carried our by using the nozzle having excessively large nozzle diameter and nozzle density, it is not easy to carry out the water-punching step and there is hardly any effect of additional improvement of the tenacity.

Furthermore, the water-punching step may be carried out while moving the web with a speed of 5 m/min or more, and preferably of 5 to 15 m/min in the water-punching step. The degree of fibrilization of the para-aramid staple fibers increases and the aramid nonwoven fabric showing more improved tenacity and the like may be prepared, because the water-punching time of the web may be longer as the moving speed of the web becomes slow. However, the mass-producibility of the aramid nonwoven fabric may be deteriorated, when the web is moved with excessively low speed.

It is possible to increase entanglements of the para-aramid staple fibers in the nonwoven fabric by fibrilizing the para-aramid staple fibers according to the preparing method disclosed above. According to this, it is possible to give very developed network structure to the aramid fibers including the para-aramid staple fibers and to make the nonwoven fabric including the aramid fibers to show very superior tenacity consequently. Furthermore, the aramid nonwoven fabric prepared by the method disclosed above can show low air permeability and small average pore size by sufficient fibrilization of the para-aramid staple fibers. Therefore, the aramid nonwoven fabric can show superior heat-insulating property that 6 do not easily transfer heat even in high temperature circumstances.

Therefore, the aramid nonwoven fabric prepared like this can be very preferably applied to the industrial heat-resistant filter, the industrial heatproof suit, and the like.

Hereinafter, the technical features and the operations of the present invention are explained in more detail according to the preferable examples of the present invention. However, the following examples are merely preferable examples of the present invention and the present invention is not limited to or by them.

EXAMPLE 1

Preparation of an Aramid Nonwoven Fabric

A web was prepared by carding aramid fibers including 10 wt % of para-aramid staple fibers and 90 wt % of meta-aramid fibers those have an average length of 50.5 mm and an average thickness of 10 μm according to a conventional carding method. At this time, a web having about 120 gsm was foamed by stacking the fibers by using a general crosslapper.

Subsequently, an aramid nonwoven fabric was prepared by water-punching the web while providing water with a water pressure of 200 bar through a nozzle having a diameter of 0.1 mm and a nozzle density of 16 ea/cm, after needle-punching the web with a density of about 400 ppsc in a needle-punching machine. At this time, the water was provided to only one side of the web in the water-punching process.

EXAMPLE 2

Preparation of an Aramid Nonwoven Fabric

The aramid nonwoven fabric was prepared substantially according to the same method as in Example 1, except that aramid fibers including 50 wt % of the para-aramid staple fibers and 50 wt % of the meta-aramid fibers were used.

EXAMPLE 3

Preparation of an Aramid Nonwoven Fabric

The aramid nonwoven fabric was prepared substantially according to the same method as in Example 1, except that aramid fibers including 100 wt % of the para-aramid staple fibers were used.

EXAMPLE 4

Preparation of an Aramid Nonwoven Fabric

The aramid nonwoven fabric was prepared substantially according to the same method as in Example 1, except that the water was provided to both sides of the web in the water-punching process.

EXAMPLE 5

Preparation of an Aramid Nonwoven Fabric

The aramid nonwoven fabric was prepared substantially according to the same method as in Example 2, except that the water was provided to both sides of the web in the water-punching process.

EXAMPLE 6

Preparation of an Aramid Nonwoven Fabric

The aramid nonwoven fabric was prepared substantially according to the same method as in Example 3, except that the water was provided to both sides of the web in the water-punching process.

COMPARATIVE EXAMPLE 1

Preparation of an Aramid Nonwoven Fabric

The aramid nonwoven fabric was prepared substantially according to the same method as in Example 1, except that only the needle-punching process was carried out without the water-punching process.

COMPARATIVE EXAMPLE 2

Preparation of an Aramid Nonwoven Fabric

The aramid nonwoven fabric was prepared substantially according to the same method as in Example 2, except that only the needle-punching process was carried out without the water-punching process.

COMPARATIVE EXAMPLE 3

Preparation of an Aramid Nonwoven Fabric

The aramid nonwoven fabric was prepared substantially according to the same method as in Example 3, except that only the needle-punching process was carried out without the water-punching process.

EXPERIMENTAL EXAMPLE 1

Identification of Fibrilization

The microstructures of the aramid nonwoven fabrics prepared in Examples 1 to 6 and Comparative Examples 1 to 3 were observed by using a Scanning Electron Microscopy (SEM, JSM-6300, JEOL Ltd., Japan). The SEM photos are annexed to FIGS. 1 to 6 (Examples 1 to 6) and FIGS. 7 to 9 (Comparative Examples 1 to 3).

Referring FIGS. 1 to 6, it is ascertained from the microstructures of the aramid nonwoven fabrics that fibrilization of the para-aramid staple fibers is occurred in the preparing process of Examples 1 to 6, and it is also ascertained that the entanglements between the para-aramid staple fibers in the aramid nonwoven fabric are increased by the fibrilization and the aramid fibers including the same have more developed network structure. Furthermore, referring FIGS. 1 to 3, it is ascertained that the degree of fibrilization and the degree of development of the network structure are increased as the content of the para-aramid staple fibers is high.

Furthermore, it is ascertained that the degree of fibrilization and the degree of development of the network structure are more increased in the cases of carrying out the water-punching process at both sides of the web than in the cases of carrying out the water-punching process at only one side of the web, when comparing FIGS. 1 to 3 and FIGS. 4 to 6.

Figure 7:
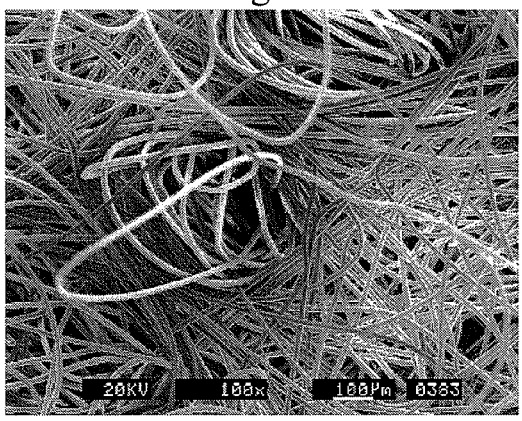
FIGS. 7 to 9 are photos of Scanning Electron Microscopy (SEM) showing microstructures of the aramid nonwoven fabrics prepared in Comparative Examples 1 to 3, respectively.
Figure 8:
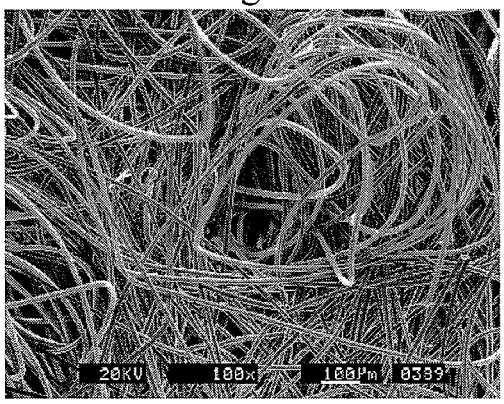
Figure 9:
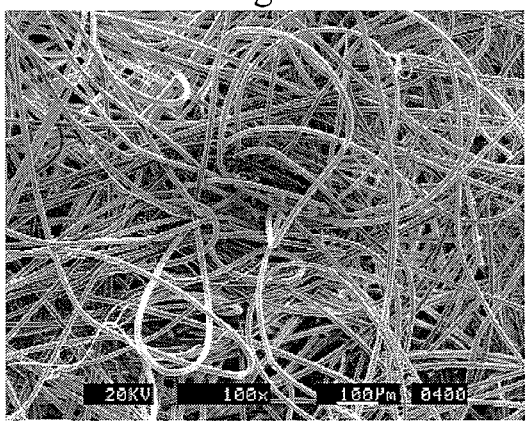

In comparison with, referring FIGS. 7 to 9, the fibrilization of the para-aramid staple fibers is hardly occurred in the preparing processes of Comparative Examples 1 to 3 where only the needle-punching process was carried out.

EXPERIMENTAL EXAMPLE 2

Measurements of Air Permeability, Average Pore Size, Thickness, and Density

Air permeability, average pore size, thickness, and density of the aramid nonwoven fabrics prepared in Examples 1 to 6 and Comparative Examples 1 to 3 were measured by the following methods.

Firstly, the air permeability was measured by Frazier method of ISO 9237 and the measuring air pressure was 125 Pa.

Furthermore, the average pore size was measured by Capillary Flow Analysis method (the measuring pressure was 0 to 0.5 psi), and the weight per unit area and the thickness of the target specimens (the aramid nonwoven fabrics) were measured and then the density of the aramid nonwoven fabrics prepared in Examples 1 to 6 and Comparative Examples 1 to 3 were calculated from the measured values.

The results are listed in the following Table 1.

TABLE 1

| | Weight per unit area ($g/m^2$) | Thickness (mm) | Density ($g/cm^3$) | Air permeability ($cm^3/cm^2/sec$) | Average pore size (μm) |
|---|---|---|---|---|---|
| Example 1 | 126.8 ± 3.74 | 1.62 ± 0.09 | 0.08 | 133.0 ± 3.24 | 46.0 |
| Example 2 | 135.2 ± 4.80 | 1.51 ± 0.09 | 0.09 | 96.9 ± 7.37 | 43.5 |
| Example 3 | 122.1 ± 4.99 | 1.37 ± 0.08 | 0.09 | 50.5 ± 3.70 | 37.5 |
| Example 4 | 106.8 ± 3.83 | 1.38 ± 0.06 | 0.08 | 143.8 ± 7.76 | 38.1 |
| Example 5 | 97.0 ± 4.46 | 1.20 ± 0.06 | 0.08 | 70.8 ± 5.57 | 30.5 |
| Example 6 | 121.8 ± 6.46 | 1.31 ± 0.08 | 0.09 | 42.8 ± 5.65 | 20.5 |
| Comparative Example 1 | 116.9 ± 5.30 | 2.30 ± 0.06 | 0.05 | 215.8 ± 3.57 | 65.6 |
| Comparative Example 2 | 107.6 ± 7.05 | 2.00 ± 0.03 | 0.05 | 208.7 ± 4.23 | 59.4 |
| Comparative Example 3 | 124.8 ± 3.98 | 2.00 ± 0.06 | 0.06 | 205.5 ± 3.85 | 52.6 |

Referring Table 1, it is ascertained that the aramid nonwoven fabrics prepared in Examples 1 to 6 have low air permeability of about 40 to 150 $cm^3/cm^2/sec$ and small average pore size of about 20 to 50 μm, because the para-aramid staple fibers included in the aramid fibers are fibrilized and the aramid fibers have developed network structure in the preparing process of Examples 1 to 6. Particularly, it is also ascertained that the degree of fibrilization and the degree of development of the network structure increase and the air permeability and the average pore size of the aramid nonwoven fabric grow less and less, when the content of the para-aramid staple fibers increases and when the water-punching process is carried out at both sides, not only one side, of the web.

Therefore, it is ascertained that the aramid nonwoven fabrics prepared in Examples 1 to 6 do not easily transfer heat even in high temperature circumstances (that is, they have superior heat-insulating property) and have suitable thickness and density to be applied to an industrial heat-resistant filter or an industrial heatproof suit.

In comparison with, it is ascertained that the aramid nonwoven fabrics prepared in Comparative Examples 1 to 3 have quite thick thickness and yet the air permeability and the average pore size are considerably large because the para-aramid staple fibers are hardly fibrilized. Therefore, the aramid nonwoven fabrics of Comparative Examples 1 to 3 are not suitable to be applied to the industrial heatproof suit and the like because of their thickness, and they are also not suitable to be applied to the industrial heat-resistant filter, the industrial heatproof suit, and the like because of inferior heat-insulating property caused by high air permeability.

EXPERIMENTAL EXAMPLE 3

Measurements of Tensile Strength, Tear Strength, and Breaking Work

Tensile strength, tear strength, and breaking work of the aramid nonwoven fabrics prepared in Examples 1 to 6 were measured by the following methods, and tensile strength of the aramid nonwoven fabrics prepared in Comparative Examples 1 to 3 were measured for comparing with the results.

Firstly, the tensile strength was measured by using a tensile tester (Instron 4467) according to the testing method of ASTM D 4632. At this time, the conditions of a load cell of 500 kgf and an extension speed of 50 mm/min were applied.

Furthermore, the tear strength and the breaking work were measured according to the testing method of ASTM D 2261 with the same conditions as the testing conditions of the tensile strength.

The results are listed in the following Tables 2 and 3.

TABLE 2

| | Direction | Tensile strength ($kgf/mm^2$) | Tear strength (kgf) | Breaking work (kgf · mm) |
|---|---|---|---|---|
| Example 1 | MD | 0.38 | 4.86 | 700.0 |
| | CD | 0.31 | 4.63 | 1043.0 |
| | MD/CD | 1.20 | 1.05 | 0.67 |
| Example 2 | MD | 0.41 | 7.07 | 702.5 |
| | CD | 0.45 | 6.12 | 1598.0 |
| | MD/CD | 0.93 | 1.16 | 0.44 |
| Example 3 | MD | 0.31 | 6.78 | 432.9 |
| | CD | 0.54 | 6.23 | 1372.0 |
| | MD/CD | 0.59 | 1.09 | 0.32 |
| Example 4 | MD | 0.41 | 3.76 | 902.6 |
| | CD | 0.29 | 3.96 | 875.0 |
| | MD/CD | 1.43 | 0.95 | 1.03 |
| Example 5 | MD | 0.44 | 4.86 | 681.7 |
| | CD | 0.37 | 4.30 | 1167.0 |
| | MD/CD | 1.19 | 1.14 | 0.58 |
| Example 6 | MD | 0.39 | 7.17 | 569.5 |
| | CD | 0.71 | 5.29 | 1103.0 |
| | MD/CD | 0.54 | 1.36 | 0.52 |

TABLE 3

| | Direction | Tensile strength (kgf/mm$^2$) |
|---|---|---|
| Comparative Example 1 | MD | 0.17 |
| | CD | 0.18 |
| | MD/CD | 0.94 |
| Comparative Example 2 | MD | 0.18 |
| | CD | 0.18 |
| | MD/CD | 1.00 |
| Comparative Example 3 | MD | 0.24 |
| | CD | 0.26 |
| | MD/CD | 0.92 |

Referring Table 2, it is ascertained that the aramid nonwoven fabrics prepared in Examples 1 to 6 have generally excellent tensile strength, tear strength, or breaking work and thus show superior tenacity because the para-aramid staple fibers included in the aramid fibers are fibrilized in the preparing process of Examples 1 to 6. It seems because the aramid fibers have developed network structure and can strengthen the aramid nonwoven fabric when the para-aramid staple fibers included in the aramid fibers are sufficiently fibrilized.

In addition to, referring Table 2, it is ascertained that the tenacity (tensile strength and tear strength) of the aramid nonwoven fabric is generally increased as the content of the para-aramid staple fibers increases and thus the degree of fibrilization of the para-aramid staple fibers increases, however, the tensile strength at the fiber direction (MD) becomes the maximum when the contents of the para-aramid staple fibers and the meta-aramid staple fibers are 50 wt % respectively, and it decreases slightly when the content of the para-aramid staple fibers more increases.

Furthermore, it is ascertained that the aramid nonwoven fabric that is prepared by carrying out the water-punching process at both sides of the web show more improved tenacity than what is prepared by carrying out the water-punching process at only one side of the web in the preparing process of the aramid nonwoven fabric.

From the facts, it can be known that the tenacity of the aramid nonwoven fabric is improved in proportion to the degree of fibrilization of the para-aramid staple fibers and the degree of development of the network structure of the aramid fibers including the same.

In comparison with, referring Table 3, it is ascertained that the para-aramid staple fibers of the aramid nonwoven fabrics prepared in Comparative Examples 1 to 3 are hardly fibrilized in the preparing process, and the air permeability and the average pore size are higher than those of Examples 1 to 6, and the tensile strength are also considerably lower than that of Examples 1 to 6. Therefore, it is ascertained that the nonwoven fabrics of Comparative Examples 1 to 3 show inferior tenacity.

Through the testing results disclosed above, it is ascertained that the aramid nonwoven fabrics of Examples 1 to 6 of which the para-aramid staple fibers are sufficiently fibrilized in the preparing process show excellent tenacity because of the fibrilization and the developed network structure and, by extension, the tenacity (particularly, tensile strength and tear strength) of the aramid nonwoven fabrics are more improved as the degree of fibrilization and the degree of development of the network structure increase and the air permeability and the average pore size decrease.

Furthermore, it is also ascertained that the aramid nonwoven fabrics have superior tenacity and heat-insulating property which are suitable to be applied to the industrial heat-resistant filter and the like, because it is clear that the aramid nonwoven fabrics show low air permeability and superior heat-insulating property of not easily transferring heat even in high temperature circumstances.

EXPERIMENTAL EXAMPLE 4

Measurements of Various Properties According to the Change of Water Pressure in the Water-Punching Process Various properties of the aramid nonwoven fabrics were measured according to the methods same as Experimental Examples 1 to 3 by applying water pressure of 100 bar, 150 bar, and 240 bar, instead of 200 bar, in the water-punching process of Examples 1 to 3 disclosed above.

Figure 10:
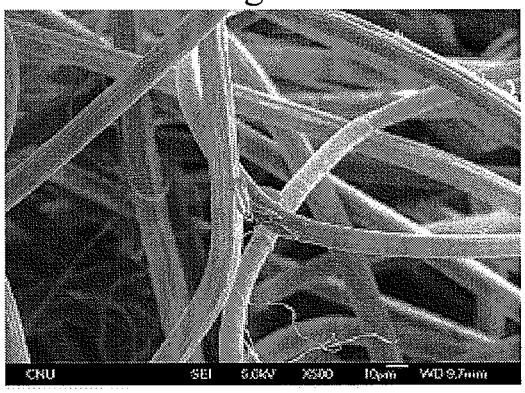
FIGS. 10 to 12 are photos of Scanning Electron Microscopy (SEM) showing microstructures of the aramid nonwoven fabrics prepared by varying the water pressure to 100 bar, 150 bar, and 240 bar in the water-punching process of Example 1, respectively.
Figure 11:
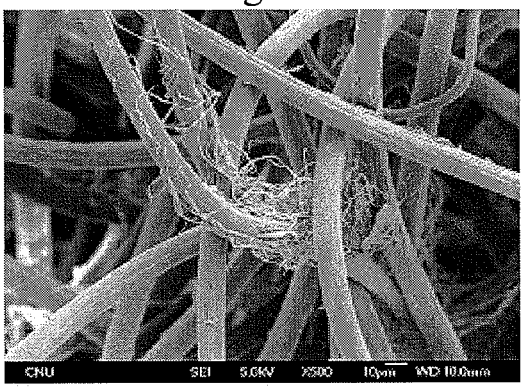
Figure 12:
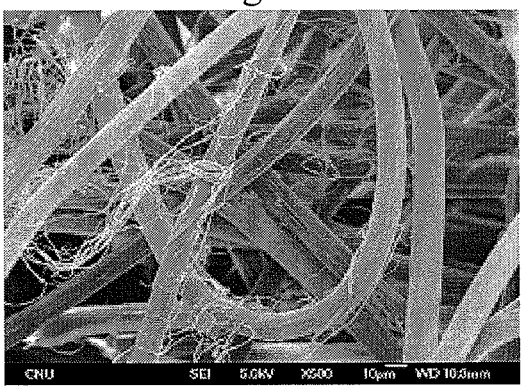

Firstly, the microstructures of the aramid nonwoven fabric prepared in Example 1 were observed while the changing the water pressure to 100 bar, 150 bar, and 240 bar in Example 1, and the photos of Scanning Electron Microscopy are annexed to FIGS. 10 to 12, respectively. Furthermore, when the water pressure was changed to 240 bar in Example 3, the microstructure of the aramid nonwoven fabric was observed and the photo of Scanning Electron Microscopy is annexed to FIG. 13.

Figure 3:
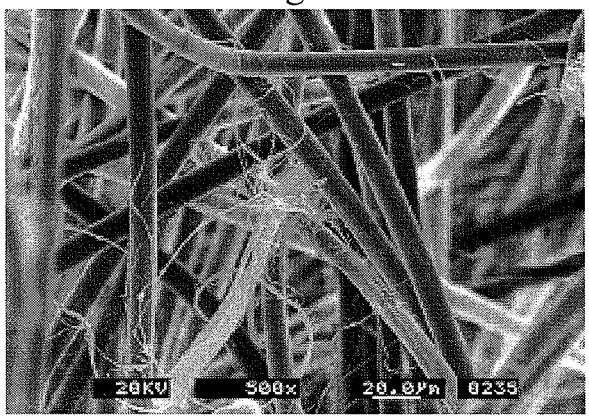
Figure 4:
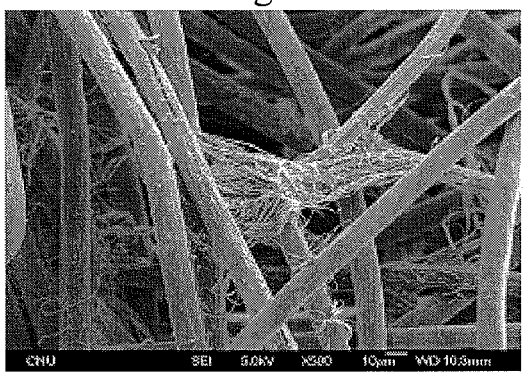
Figure 5:
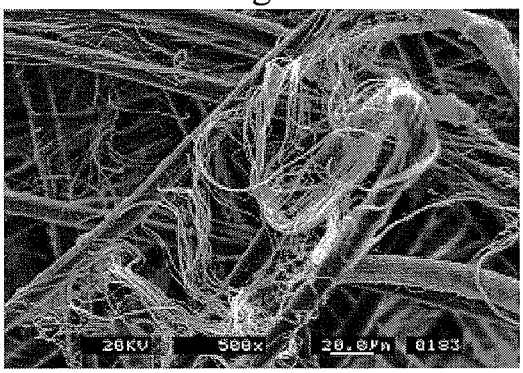
Figure 6:
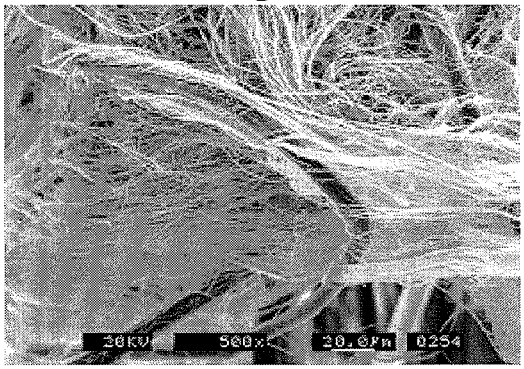
Figure 13:
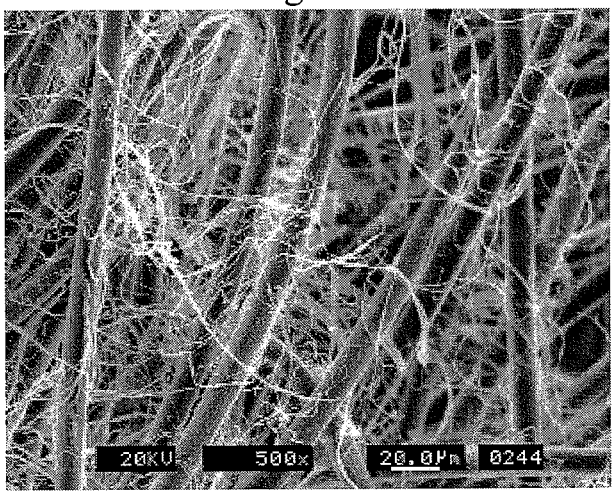
FIG. 13 is a photo of Scanning Electron Microscopy (SEM) showing microstructures of the aramid nonwoven fabrics prepared by changing the water pressure to 240 bar in the water-punching process of Example 4.

Referring FIGS. 1, and 10 to 12, it is ascertained that the degree of fibrilization of the para-aramid staple fibers increases as the water pressure in the water-punching process increases, and it is also recognized by comparing FIGS. 3 and 13.

Subsequently, the air permeability of the aramid nonwoven fabrics when the water pressure was changed to 100 bar, 150 bar, and 240 bar in Example 1 and when the water pressure was changed into 240 bar in Example 3 was measured, and the results are listed in the following Table 4 in comparison with the result previously measured with the water pressure of 200 bar.

TABLE 4

| | Air permeability (cm$^3$/cm$^2$/sec) |
|---|---|
| Example 1 (100 bar) | 135.2 ± 1.30 |
| Example 1 (150 bar) | 124.2 ± 4.02 |
| Example 1 (200 bar) | 133.0 ± 3.24 |
| Example 1 (240 bar) | 117.8 ± 8.41 |
| Example 3 (200 bar) | 50.5 ± 3.70 |
| Example 3 (240 bar) | 46.1 ± 7.93 |

Referring Table 4, it is ascertained that the air permeability of the aramid nonwoven fabrics prepared finally in Examples 1 to 3 decrease as the water pressure in the water-punching process is high and, considering the result in company with the observation results of the microstructure disclosed above, the degree of fibrilization of the para-aramid staple fibers increases as the water pressure in the water-punching process is high and the air permeability of the aramid nonwoven fabrics gets lower in proportion to this. From this, it is recognized that the heat-insulating property of the aramid nonwoven fabrics also increases in proportion to this.

Lastly, tensile strength, tear strength, and breaking work of the prepared aramid nonwoven fabrics when changing the water pressure to 100 bar, 150 bar, and 240 bar in Example 1 and when changing the water pressure to 240 bar in Example 3 were measured and the results are listed in the following Table 5 in comparison with the result previously measured with the water pressure of 200 bar.

TABLE 5

| | Direction | Tensile strength ($kgf/mm^2$) | Tear strength (kgf) | Breaking work (kgf · mm) |
|---|---|---|---|---|
| Example 1 (100 bar) | MD | 0.32 | 4.66 | 690.4 |
| | CD | 0.28 | 4.70 | 891.2 |
| | MD/CD | 1.15 | 0.99 | 0.77 |
| Example 1 (150 bar) | MD | 0.38 | 4.70 | 623.0 |
| | CD | 0.29 | 4.44 | 1371.0 |
| | MD/CD | 1.32 | 1.06 | 0.45 |
| Example 1 (200 bar) | MD | 0.38 | 4.86 | 700.0 |
| | CD | 0.31 | 4.63 | 1043.0 |
| | MD/CD | 1.20 | 1.05 | 0.67 |
| Example 1 (240 bar) | MD | 0.39 | 4.23 | 791.5 |
| | CD | 0.32 | 5.19 | 872.0 |
| | MD/CD | 1.25 | 0.82 | 0.91 |
| Example 3 (200 bar) | MD | 0.31 | 6.78 | 432.9 |
| | CD | 0.54 | 6.23 | 1372.0 |
| | MD/CD | 0.57 | 1.09 | 0.32 |
| Example 3 (240 bar) | MD | 0.31 | 7.15 | 449.8 |
| | CD | 0.64 | 6.24 | 1420.0 |
| | MD/CD | 0.48 | 1.15 | 0.32 |

Referring Table 5, the tenacity of the aramid nonwoven fabrics prepared finally in Examples 1 to 3 is more improved as the water pressure in the water-punching process is high and, considering the result in company with the observation results of the microstructure disclosed above, the degree of fibrilization of the para-aramid staple fibers increases as the water pressure in the water-punching process is high and the tenacity of the aramid nonwoven fabrics increases in proportion to this.

What is claimed is:

1. A method of preparing an aramid nonwoven fabric, including the steps of:

carding aramid fibers including 10 to 100 wt % of para-aramid staple fibers and 0 to 90 wt % of meta-aramid staple fibers so as to form a web;

needle-punching the web; and water-punching the web with a water pressure of 70 to 350 bar.

2. The method according to claim 1, wherein the web is needle-punched with a condition of 300 to 800 ppsc (punch/$cm^2$) in the needle-punching step.

3. The method according to claim 1, wherein the water-punching step includes a pre-step of water-punching the web with a water pressure of 50 to 150 bar and a main-step of water-punching the web with a water pressure of 70 to 350 bar, and the water pressure of the main-step is higher than that of the pre-step.

4. The method according to claim 1, wherein the water-punching is carried out at both sides of the web in the water-punching step.

5. The method according to claim 1, wherein the water-punching is carried out while providing water to the web through a nozzle having a diameter of 0.1 to 0.15 mm and a density of 10 to 20 ea/cm in the water-punching step.

6. The method according to claim 1, wherein the water-punching is carried out while moving the web with a speed of 5 m/min or more in the water-punching step.

* * * * *